US005238791A

United States Patent [19]

Tappe et al.

[11] Patent Number: 5,238,791

[45] Date of Patent: Aug. 24, 1993

[54] BLEACHING BATH

[75] Inventors: Gustav Tappe, Leverkusen; Ralf Wichmann, Koeln; Heinz Meckl, Bergisch Gladbach, all of Fed. Rep. of Germany

[73] Assignee: AGFA Gevaert Aktiengesellschaft, Leverkusen, Fed. Rep. of Germany

[21] Appl. No.: 799,766

[22] Filed: Nov. 27, 1991

Related U.S. Application Data

[63] Continuation of Ser. No. 601,501, Oct. 23, 1990, abandoned.

[30] Foreign Application Priority Data

Dec. 1, 1989 [DE] Fed. Rep. of Germany ..... 3939755

[51] Int. Cl.[5] ..... G03C 7/42

[52] U.S. Cl. ..... 430/393; 430/430; 430/461

[58] Field of Search ..... 430/393, 400, 430, 455, 430/461, 491

[56] References Cited

U.S. PATENT DOCUMENTS

| | | | |
|---|---|---|---|
| 4,707,434 | 11/1987 | Koboshi et al. | 430/430 |
| 4,745,048 | 5/1988 | Kishimoto et al. | 430/430 |
| 4,756,918 | 7/1988 | Ueda et al. | 430/400 |
| 4,769,312 | 9/1988 | Kishimoto et al. | 430/393 |
| 4,775,612 | 10/1988 | Abe et al. | 430/460 |
| 4,914,008 | 4/1990 | Kurematsu et al. | 430/393 |
| 4,952,488 | 8/1990 | Mihayashi et al. | 430/430 |
| 4,983,503 | 1/1991 | Ishikawa et al. | 430/400 |

*Primary Examiner*—Hoa Van Le

*Attorney, Agent, or Firm*—Connolly & Hutz

[57] ABSTRACT

A readily biodegradable bleaching bath having an adequate bleaching effect (1) contains an iron(III) complex salt in which at least 20 mol-% and preferably at least 80 mol-% of the complexing agent corresponds to formula (I)

$$(HOOC-CH_2)_x-N-[CH_2-\overset{\overset{R_1}{|}}{(CH)}_n-COOH]_y \quad (I)$$

in which $R_1$ is hydrogen or hydroxy, n is 1 or 2, x is 2 or 3 and y is 0 or 1 and the sum of x and y is always 3, and (2) an excess of free complexing agent of 1 to 120 mol-% and preferably 5 to 20 mol-%, based on the iron complex or the iron complex salt, and (3) is adjusted to a pH value of $\leqq 4.5$.

2 Claims, No Drawings

BLEACHING BATH

CROSS-REFERENCE TO RELATED APPLICATION

This application is a continuation of the copending U.S. application Ser. No. 07/601,501, filed Oct. 23, 1990, now abandoned, by Gustav Tappe, Ralf Wichmann, Heinz Meckl entitled Bleaching Bath.

This invention relates to an environment-friendly bleaching bath suitable for the processing of color photographic silver halide materials.

Iron complex salts of aminopolycarboxylic acids, for example the iron ammonium complex salt of ethylenediamine tetraacetic acid, are typically used to bleach the silver formed during the development of color photographic materials. These and similar complexing agents likewise used for this purpose are not readily biodegradable.

Bleaching baths containing iron complex salts of readily biodegradable complexing agents, such as nitrilotriacetic acid, do not develop sufficient bleaching power in the bleaching of color photographic materials under the usual conditions at pH 6 to 8.

The problem addressed by the present invention was to provide a bleaching bath suitable for the processing of color photographic silver halide materials which contained readily biodegradable constituents and developed an adequate bleaching effect.

This problem is solved by a bleaching bath which (1) contains an iron(III) complex salt in which at least 20 mol-% and preferably at least 80 mol-% of the complexing agent corresponds to formula (I)

$$(HOOC-CH_2)_x-N-[CH_2-\overset{\overset{R_1}{|}}{(CH)}_n-COOH]_y \qquad (I)$$

in which $R_1$ is hydrogen or hydroxy, n is 1 or 2, x is 2 or 3 and y is 0 or 1 and the sum of x and y is always 3, and (2) an excess of free complexing agent of 1 to 120 mol-% and preferably 5 to 20 mol-%, based on the iron complex or the iron complex salt, and (3) is adjusted to a pH value of $\leqq 4.5$.

The complexing agents corresponding to formula (I) may be pure substances or even mixtures.

Preferred compounds corresponding to formula (I) are nitrilotriacetic acid and nitrilomonopropionodiacetic acid which correspond to the formulae $$N-(CH_2COOH)_2 \text{ and}$$

$$(HOOC-CH_2)_2-N-CH_2-CH_2-COOH.$$

The remaining at most 80 mol-% or preferably at most 20 mol-% of the complexing agents may be typical complexing agents, such as ethylenediamine tetraacetic acid or propylenediamine tetraacetic acid. In a preferred embodiment, only the complexing agents according to the invention are used.

The iron complex or iron complex salt is used in particular in a quantity of 0.005 to 0.5 mol/l.

In addition to the components according to the invention, bleaching baths contain a halide to rehalogenate the silver.

Suitable halides for the bleaching baths are, in particular, the chlorides and bromides of sodium, potassium and ammonium.

In its ready-to-use state, the bleaching bath contains 0.05 to 1.5 mol/l halide.

The bleaching bath according to the invention is particularly suitable for color photographic silver halide recording materials of which the silver halide emulsions consist predominantly of AgBr, AgBrI, AgBrCl or AgCl. The color photographic material preferably contains at least one blue-sensitive, at least one green-sensitive and at least one red-sensitive silver halide emulsion layer, with which at least one yellow coupler, at least one magenta coupler and at least one cyan coupler are associated in that order, on a reflective or transparent support (for example paper coated on both sides with polyethylene or cellulose triacetate film).

The bleaching bath according to the invention is used in the process typically used for processing color photographic silver halide materials which comprises the steps of exposure, development, optionally stopping, bleaching, fixing or bleaching/fixing, rinsing, optionally stabilization and drying; the rinsing step can be omitted where a stabilizing bath is used at the end of processing.

Processing may be carried out continuously with continuous regeneration of the individual processing baths.

The bleaching baths described in the Examples were tested for their bleaching behavior (residual silver in the processed material).

Determination of Residual Silver

After exposure and processing as described below, a step wedge of the photographic material was examined for residual silver in the black parts of the image using a Photo-Matic PM 8030 infrared silver detector (Photo-Matic, Denmark).

Information on the biological degradability of the complexing agent used in the bleaching bath according to the invention can be found in the publication: Nitrilotriessigsäure, BUA-Stoffbericht 5 (October 1986), published by the Bundesgremium für umweltrelevante Altstoffe (BUA) der Gesellschaft Deutscher Chemiker, Verlag Chemie, Weinheim 1987.

EXAMPLE 1 (INVENTION)

A color photographic recording material was produced by application of the following layers in the order indicated to a layer support of paper coated on both sides with polyethylene. The quantities shown are all based on 1 $m^2$. For the silver halide applied, the corresponding quantities of $AgNO_2$ are shown.

Layer Composition

1st Layer (substrate layer):

0.2 g gelatine

2nd Layer (blue-sensitive layer):

blue-sensitive silver halide emulsion (99.5 mol-% chloride, 0.5 mol-% bromide, mean grain diameter 0.8 μm) of 0.63 g $AgNO_3$ containing 1.38 g gelatine 0.95 g yellow coupler Y 20 0.29 g tricresyl phosphate (TCP)

3rd Layer (protective layer)

1.1 g gelatine 0.06 g 2,5-dioctylhydroquinone
0.06 g dibutyl phthalate (DBP)
4th Layer (green-sensitive layer)
green-sensitized silver halide emulsion (99.5 mol-% chloride, 0.5 mol-% bromide, mean grain diameter 0.6 μm) of 0.45 g $AgNO_3$ containing
1.08 g gelatine
0.41 g magenta coupler M
0.08 g 2,5-dioctylhydroquinone
0.34 g DBP
0.04 g TCP
5th Layer (UV-absorbing layer)
1.15 g gelatine 0.15 g UV absorber, same as in 5th layer
0.2 g TCP
8th Layer (protective layer)
0.9 g gelatine
0.3 g hardener H corresponding to the formula

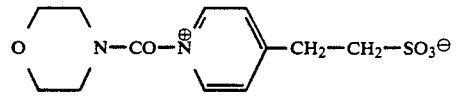

The components used correspond to the following formulae:

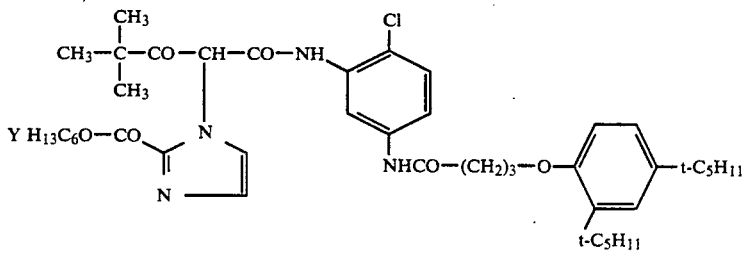

M

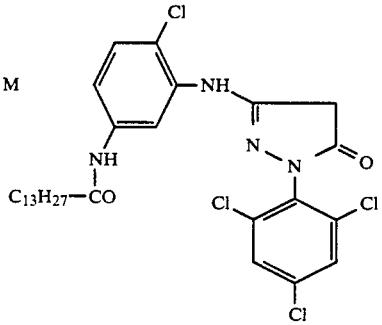

C

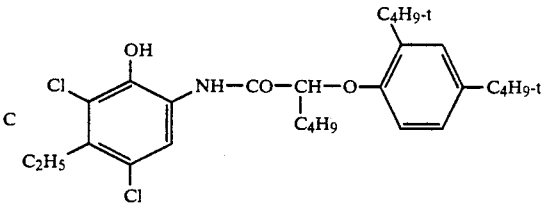

0.6 g UV absorber corresponding to the formula

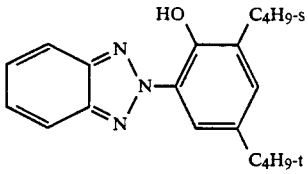

0.045 g 2,5-dioctylhydroquinone
0.04 g TCP
6th Layer (red-sensitive layer)
red-sensitized silver halide emulsion (99.5 mol-% chloride, 0.5 mol-% bromide, mean grain diameter 0.5 μm) of 0.3 g $AgNO_3$ containing
0.75 g gelatine
0.36 g cyan coupler C
0.36 g TCP
7th Layer (UV-absorbing layer)
0.35 g gelatine A step wedge was exposed onto the photographic recording material described above and processed as follows:

| | | |
|---|---|---|
| development | 45s | 35° C. |
| rinsing | 22s | <20° C. |
| bleaching | 90s | 35° C. |
| rinsing | 45s | 30° C. |
| fixing | 45s | 35° C. |
| rinsing | 90s | approx. 30° C. |
| drying | | |

The individual processing baths had the following composition:

| Developer: | |
|---|---|
| Water | 900 ml |
| Ethylenediamine tetraacetic acid (EDTA) | 2 g |
| Hydroxyethane diphosphonic acid (HEDP), 60% by wt. | 0.5 ml |
| Sodium chloride | 2 g |

-continued

| | |
|---|---|
| N,N-diethyl hydroxylamine, 85% by wt. | 5 ml |
| 4-(N-ethyl-N-2-methanesulfonylaminoethyl)-2-methyl phenylenediamine sesquisulfate monohydrate (CD3), 50% by weight | 8 ml |
| Potassium carbonate | 25 g |
| Adjust pH to 10 with KOH or $H_2SO_4$. | |
| Make up with water to 1 liter | |
| Bleaching bath A | |
| Water | 800 ml |
| Iron(III) nitrate $9H_2O$ | 40 g |
| Nitrilotriacetic acid | 25 g |
| *Ammonia, 25% by weight | approx. 30 ml |
| Ammonium bromide | 40 g |
| Water to 1 liter | |
| Fixing bath | |
| Water | 900 ml |
| Sodium sulfite | 10 g |
| Ammonium thiosulfate | 100 g |
| Adjust to pH 7 with ammonia or acetic acid. | |
| Make up with water to 1 liter. | |

*for adjustment to pH 4

The result of the determination of residual silver is shown in Table 1.

EXAMPLE 2 (COMPARISON)

Exposure and processing were carried out as in Example 1. The developer had the same composition as in Example 1.

| | |
|---|---|
| Bleaching bath B | |
| Water | 800 ml |
| Iron(III) nitrate $9H_2O$ | 40 g |
| Nitrilotriacetic acid | 25 g |
| *Ammonia, 25% by weight | approx. 40 ml |
| Ammonium bromide | 40 g |
| Water to 1 liter | |
| Fixing bath | as Example 1 |

*for adjustment to pH 6.

The result of the determination of the residual silver is shown in Table 1.

EXAMPLE 3 (COMPARISON)

Exposure and processing were carried out as in Example 1. The developer had the same composition as in Example 1.

| | |
|---|---|
| Bleaching bath C | |
| Water | 800 ml |
| Ammonium-iron(III) EDTA | 50 g |
| EDTA | 5 g |
| Ammonium bromide | 80 g |
| Adjust to pH 6.0 with ammonia water or acetic acid. | |
| Make up with water to 1 liter. | |

Fixing Bath as Example 1

The result of the determination of residual silver is shown in Table 1.

TABLE 1

| Bleaching bath | Reading of the silver detector* |
|---|---|
| A | 4 |
| B | 9 |
| C | 4 |

*Values above 6 indicate the presence of residual silver.

Table 1 shows the good bleaching effect of bleaching bath A according to the invention which contains a biodegradable complexing agent. The bleaching effect corresponds to that of the typical bleaching bath C containing EDTA which is not readily biodegradable. By contrast, bleaching bath B which has substantially the same composition as bleaching bath A, but is in the pH range prescribed for EDTA bleaching baths, has an inadequate bleaching effect.

EXAMPLE 4 (INVENTION)

The following layers were applied in the order shown to a transparent layer support of cellulose triacetate. The quantities shown are all based on 1 $m^2$. For the silver halide applied, the equivalent quantities of $AgNO_3$ are shown.

All the silver halide emulsions were stabilized with 0.1 g 4-hydroxy-6-methyl-1,3,3*a*,7-tetraazaindene per 100 g $AgNO_3$.

1st Layer (Anti-Halo Layer)

0.2 g black colloidal silver
1.2 g gelatine
0.1 g UV absorber UV 1
0.2 g UV absorber UV 2
0.02 g tricresyl phosphate
0.03 g dibutyl phthalate

2nd Layer (Micrate Intermediate Layer)

0.25 g $AgNO_3$ of a micrate Ag (Br, I) emulsion: average grain diameter 0.07 μm, 0.5 mol-% iodide)
1.0 g gelatine
0.05 g colored coupler RM 1
0.10 g tricresyl phosphate

3rd Layer (Low-Sensitivity Red-Sensitized Layer)

2.2 g $AgNO_3$, 4 mol-% iodide, mean grain diameter 0.45 μm, red-sensitized
2.0 g gelatine
0.6 g colorless cyan coupler C 1 emulsified in 0.5 g tricresyl phosphate (TCP)
50 mg colored cyan coupler RM 1 and
30 mg DIR coupler DIR 1 emulsified in 20 mg TCP.

6th Layer (High-Sensitivity Red-Sensitized Layer)

2.8 g $AgNO_3$, 8.5 mol-% iodide, mean grain diameter 0.8 μm, red-sensitized
1.8 g gelatine
0.15 g colorless cyan coupler C 2 emulsified with 0.15 g dibutyl phthalate (DBP)

5th Layer (Separation Layer)

0.7 g gelatine
0.2 g 2,5-diisooctyl hydroquinone emulsified with 0.15 g DBP

6th Layer (Low-Sensitivity Green-Sensitized Layer)

1.8 g $AgNO_3$ of a spectrally green-sensitized Ag(Br,I) emulsion containing 4.5 mol-% iodide, mean grain diameter 0.4 μm, green-sensitized,
1.6 g gelatine
0.6 g magenta coupler M 1 (latex coupler)
50 mg mask coupler YM 1 emulsified with 50 mg TCP
30 mg DIR coupler DIR 2 emulsified in 20 mg DBP
80 mg DIR coupler DIR 3 emulsified in 60 mg TCP

7th Layer (High-Sensitivity Green-Sensitized Layer)

2.2 g $AgNO_3$ containing 7 mol-% iodide, mean grain diameter 0.7 μm, green-sensitized, 4 g gelatine
0.15 g magenta coupler M 2 emulsified with 0.45 g TCP
mg mask coupler, same as 6th layer, emulsified with 30 mg TCP.

8th Layer (Separation Layer)

0.5 g gelatine
0.1 g 2,5-diisooctyl hydroquinone emulsified with 0.08 g DBP

9th Layer (Yellow Filter Layer)

0.2 g Ag (yellow colloidal silver sol)
0.9 g gelatine
0.2 g 2,5-diisooctyl hydroquinone emulsified with 0.16 g DBP 10th Layer (Low-Sensitivity Blue-Sensitive Layer)

0.6 g $AgNO_3$, 4.9 mol-% iodide, mean grain diameter 0.45 μm, blue-sensitized,
0.85 g gelatine
0.7 g yellow coupler Y 1 emulsified with 0.7 g TCP
0.5 g DIR coupler DIR 3 emulsified with 0.5 g TCP 11th Layer (High-Sensitivity Blue-Sensitive Layer)

1.0 g $AgNO_3$, 9.0 mol-% iodide, mean grain diameter 0.9 μm, blue-sensitized,
0.85 g gelatine
0.3 g yellow coupler, same as 10th layer, emulsified with 0.3 g TCP.

12th Layer (Protective and Hardening Layer)

0.5 g $AgNO_3$ of a micrate Ag(Br,I) emulsion, mean grain diameter 0.07 μm, 0.5 mol-% iodide
1.2 g gelatine
0.4 g hardener corresponding to the formula $$(CH_2{=}CH{-}SO_2{-}CH_2{-}CONH{-}CH_2{-})_2{-}$$

1.0 g formaldehyde scavenger corresponding to the formula

UV absorber UV-1

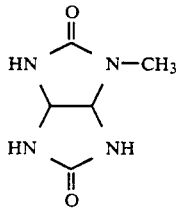

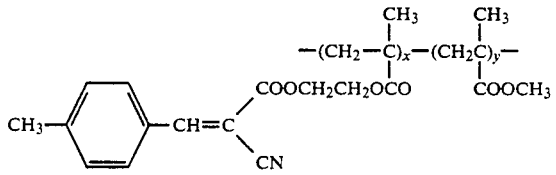

ratio by weight x:y + 7:3

UV absorber UV-2

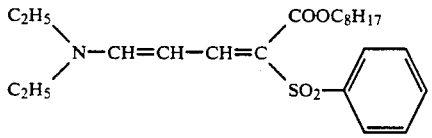

C1:

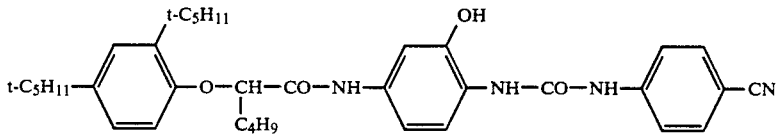

C2:

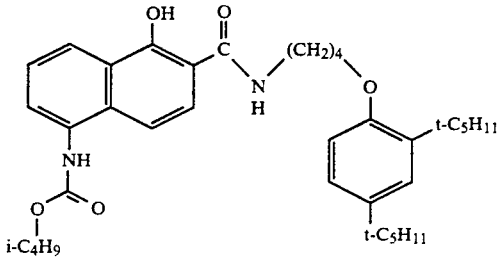

M1

-continued
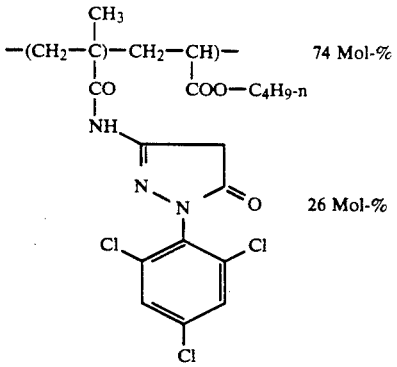
M2
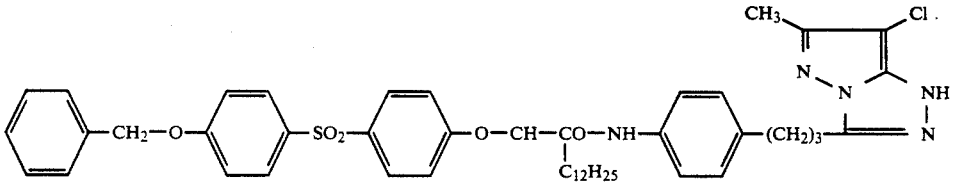
Y1
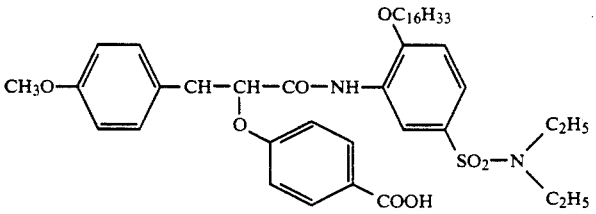
RM1
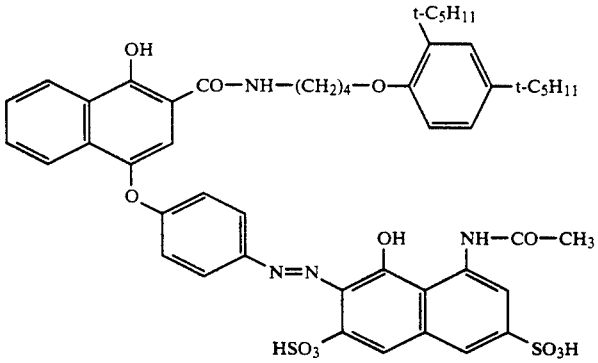
YM1
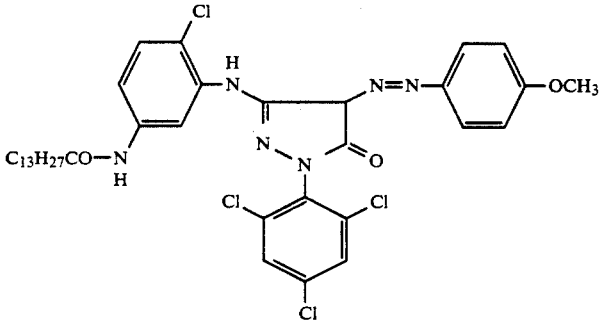
DIR1

-continued

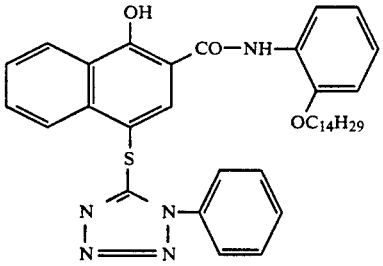

DIR2

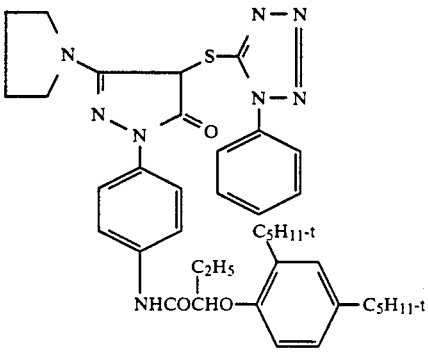

DIR3

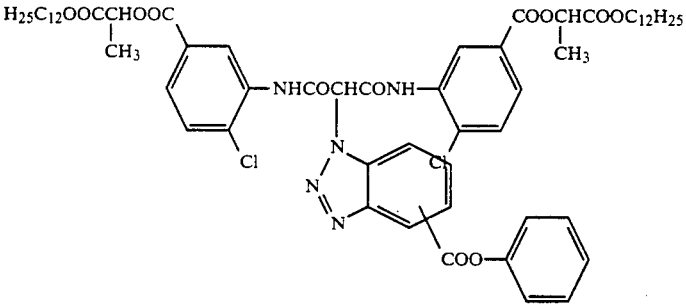

A step wedge was exposed onto the photographic material described above and processed as follows:

| | | | |
|---|---|---|---|
| Developer | 3 min. | 15 s | 37.8° C. |
| Bleaching bath | 4 min. | 20 s | 38° C. |
| Rinsing | 1 min. | 5 s | 38° C. |
| Fixing bath | 4 min. | 20 s | 38° C. |
| Rinsing | 3 min. | 15 s | 38° C. |
| Final bath | 1 min. | 5 s | 38° C. |

The processing baths had the following composition:

| | |
|---|---|
| Developer: | |
| Water | 800 ml |
| Potassium carbonate | 37.5 g |
| Sodium sulfite | 4.25 g |
| Potassium iodide | 1.2 mg |
| Sodium bromide | 1.3 g |
| Hydroxylamine sulfate | 2.0 g |
| Diethylenetriamine pentaacetic acid | 2.0 g |
| 4-(N-ethyl-N-B-hydroxyethylamino)-2-methyl aniline sulfate | 4.75 g |
| Make up with water to 1 liter | |
| pH 10.0 | |
| Bleaching bath D | |
| Water | 600 ml |
| Iron salt of nitrilodiaceticmonopropionic acid | 70 g |

-continued

| | |
|---|---|
| Nitrilodiaceticmonopropionic acid | 5.5 g |
| Ammonium bromide | 150 g |
| Ammonium nitrate | 16 g |
| Adjust to pH 4.2 with ammonia or acetic acid. | |
| Make up to 1 liter. | |
| Fixing bath | |
| Water | 800 ml |
| Ammonium thiosulfate solution (58% by weight) | 162 ml |
| Ethylenediamine tetraacetic acid | 1.3 g |
| Sodium bisulfite | 13 g |
| Sodium hydroxide | 2.4 g |
| Make up with water to 1 liter | |
| pH 6.5 | |
| Final bath | |
| Water | 800 ml |
| Formalin (37% by weight) | 3 ml |
| Polyoxyethylene-p-monononyl phenyl ether | 0.5 g |
| Make up with water to 1 liter | |

The result of the determination of residual silver is shown in Table 2 below. The color image produced was true-to-type.

EXAMPLE 5 (COMPARISON)

Exposure and processing were carried out as described in Example 4. The developer, fixing and final baths had the same composition as in Example 4.

| Bleaching bath E | |
|---|---|
| Water | 600 ml |
| Iron salt of nitrilodiaceticmonopropionic acid | 70 g |
| Nitrilodiaceticmonopropionic acid | 5.5 g |
| Ammonium bromide | 150 g |
| Ammonium nitrate | 16 g |
| Adjust to pH 6.0 with ammonia or acetic acid. | |
| Make up with water to 1 liter. | |

EXAMPLE 6 (COMPARISON)

Exposure and processing were carried out as described in Example 4. The developer, fixing and final baths had the same composition as in Example 4.

| Bleaching bath F | |
|---|---|
| Water | 600 ml |
| Ammonium-iron(III)-EDTA | 99 g |
| Acetic acid (80% by weight) | approx. 10 ml |
| Ammonium bromide | 150 g |
| Ammonium nitrate | 16 g |
| Adjust to pH 6.0 with ammonia or acetic acid. | |
| Make up with water to 1 liter. | |

The result of the determination of residual silver is shown in Table 2 below.

TABLE 2

| Bleaching bath | Reading of the silver detector* |
|---|---|
| D | 4 |
| E | 9 |
| F | 4 |

*Values above 6 indicate the presence of residual silver.

As can be seen from Table 2, the bleaching effect of the bleaching bath D according to the invention containing a biodegradable complexing agent corresponds to the bleaching effect of the typical bleaching bath F containing EDTA which is not readily biodegradable. By contrast, bleaching bath E which has substantially the same composition as bleaching bath D, but has a pH value typical of EDTA bleaching baths, has an inadequate bleaching effect. The bleaching tests showed that bleaching bath D according to the invention does not lead to the formation of leuco cyan dye whereas a typical bleaching bath containing EDTA shows distinct losses of cyan dye at a corresponding pH value.

We claim:

1. A bleaching bath which contains
   (1) an iron(III)-complex salt in which at least 80 mol-% of the complexing agent is nitrilomonopropionodiacetic acid, and
   (2) an excess of free complexing agent of 5 to 20 mol-%, based on the iron complex salt, and
   (3) is adjusted to a pH-value of ≦4.5, wherein said iron(III)-complex salt is contained in an amount of 0.005 to 0.5 mol/l. of said bath.

2. A method for bleaching a light sensitive silver halide color photographic material to decrease residual silver which comprises after color developing subjecting the color photographic material to a bath which contains
   (1) an iron(III)-complex salt in which at least 80 mol-% of the complexing agent is nitrilomonopropionodiacetic acid, and
   (2) an excess of free complexing agent of 5 to 20 mol-%, based on the iron complex salt, and
   (3) is adjusted to a pH-value of ≦4.5, wherein said iron(III)-complex salt is contained in an amount of 0.005 to 0.5 mol/l. of said bath.

* * * * *